US010760366B2

(12) United States Patent
Mack et al.

(10) Patent No.: US 10,760,366 B2
(45) Date of Patent: Sep. 1, 2020

(54) COILED TUBING CONNECTOR TO ELECTRICAL SUBMERSIBLE PUMP

(71) Applicant: Baker Hughes Oilfield Operations LLC, Houston, TX (US)

(72) Inventors: John Jay Mack, Catoosa, OK (US); Kenneth O'Grady, Collinsville, OK (US); Kade Hammet Poper, Broken Arrow, OK (US); Joseph Scott Thompson, Owasso, OK (US); Mark Bellmyer, Broken Arrow, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/418,423

(22) Filed: May 21, 2019

(65) Prior Publication Data

US 2019/0360293 A1 Nov. 28, 2019

Related U.S. Application Data

(60) Provisional application No. 62/675,813, filed on May 24, 2018.

(51) Int. Cl.

| | |
|---|---|
| ***E21B 33/038*** | (2006.01) |
| ***E21B 17/02*** | (2006.01) |
| ***E21B 33/04*** | (2006.01) |
| ***H01R 13/523*** | (2006.01) |

(52) U.S. Cl.

CPC ..... *E21B 33/0385* (2013.01); *E21B 17/028* (2013.01); *E21B 33/0407* (2013.01); *H01R 13/523* (2013.01)

(58) Field of Classification Search

CPC .... E21B 17/023; E21B 17/028; E21B 17/203; E21B 17/206; E21B 33/0385; E21B 33/0407; E21B 43/128

See application file for complete search history.

(56) References Cited

U.S. PATENT DOCUMENTS

| | | | | |
|---|---|---|---|---|
| 5,051,103 | A * | 9/1991 | Neuroth | E21B 33/0385 439/192 |
| 5,377,747 | A | 1/1995 | Didier | |
| 6,298,917 | B1 | 10/2001 | Kobylinski et al. | |
| 9,657,556 | B2 | 5/2017 | Tanner et al. | |

(Continued)

OTHER PUBLICATIONS

International Search Report and Written Opinion for related PCT application PCT/US2019/033302 dated Sep. 11, 2019: pp. 1-9.

*Primary Examiner* — James G Sayre

(74) *Attorney, Agent, or Firm* — Bracewell LLP; James E. Bradley

(57) ABSTRACT

A connector secures an ESP to coiled tubing containing a power cable. Upper and lower barriers in the connector housing define an upper chamber, a lower chamber, and a center chamber. An upper chamber dielectric fluid in the upper chamber is in fluid communication with the interior of the coiled tubing. A lower chamber dielectric fluid in the lower chamber is in fluid communication with motor lubricant in the motor of the ESP. Center chamber dielectric fluid in the center chamber is sealed from contact with the upper and lower chamber dielectric fluids by the upper and lower barriers. A thermal expansion device has a container portion for allowing center chamber dielectric fluid to expand into the container.

20 Claims, 4 Drawing Sheets

(56) References Cited

U.S. PATENT DOCUMENTS

| | | | | |
|---|---|---|---|---|
| 2003/0127223 | A1 | 7/2003 | Branstetter et al. | |
| 2012/0279718 | A1* | 11/2012 | Rocke | E21B 17/028 166/341 |
| 2014/0097001 | A1 | 4/2014 | Campbell et al. | |
| 2017/0187177 | A1 | 6/2017 | Mangum | |
| 2018/0020242 | A1 | 1/2018 | Pettersson et al. | |
| 2018/0323587 | A1 | 11/2018 | O'Grady et al. | |
| 2019/0106948 | A1 | 4/2019 | O'Grady et al. | |

* cited by examiner

COILED TUBING CONNECTOR TO ELECTRICAL SUBMERSIBLE PUMP

CROSS REFERENCE TO RELATED APPLICATION

This application claims priority to provisional application 62/675,813, filed May 24, 2018.

FIELD OF THE DISCLOSURE

This disclosure relates in general to electrical submersible well pumps (ESP), and in particular to a connector for connecting coiled tubing containing a power cable to the ESP.

BACKGROUND

Electrical submersible well pumps are often used to pump liquids from hydrocarbon producing wells. A typical ESP includes a pump driven by an electrical motor. Production tubing, which comprises pipes having threaded ends secured together, supports the ESP in most installations. The pump normally pumps well fluid into the production tubing. A power cable extends alongside the production tubing to the motor for supplying power. Installing and retrieving the ESP requires a workover rig to pull the production tubing.

In other installations, coiled tubing supports the ESP. The coiled tubing comprises a continuous length or segment of steel tubing that can be wound on a large reel at the surface before deploying and after retrieving. A power cable with power conductors for supplying power to the motor extends through the coiled tubing. The pump discharges well fluid up the annulus surrounding the coiled tubing. A coiled tubing installation allows the ESP to be installed and retrieved without the need for a workover rig.

A connector secures the coiled tubing to the upper end of the motor, which is located above the pump. The motor is filled with a dielectric lubricant for lubricating the bearings. A seal section between the motor and the pump has a bellows or flexible bag that contracts and expands to equalize the pressure of the dielectric lubricant with the well fluid pressure surrounding the motor. The connector also has electrical connections to connect the motor wires with the conductors in the power cable. In the prior art, the connector will have features to reduce the chance for well fluid that might leak into the connector from migrating down into the motor. At least some prior art connectors are filled with a dielectric fluid that immerses the electrical connections in the connector. A bellows or check valve may have been used to accommodate thermal expansion of the dielectric fluid in the connector.

Also, some prior art connectors have the ability to part in the event the ESP becomes stuck in the well, enabling the operator to retrieve the coiled tubing then run back in with a fishing string to engage and pull the stuck ESP from the well.

SUMMARY

An apparatus connects an electrical submersible pump assembly (ESP) to a string of coiled tubing containing a power cable having power conductors. The ESP and coiled tubing are adapted to be installed within a well. The ESP has a pump, a motor, and a pressure equalizer for reducing a pressure difference between motor lubricant in the motor and well fluid surrounding the motor. The apparatus comprises a tubular housing configured to connect between a lower end of the coiled tubing and an upper end of the motor. Upper and lower barriers in the housing define an upper chamber above the upper barrier, a center chamber between the upper and lower barriers, and a lower chamber below the lower barrier. Upper electrical terminals in the upper barrier are configured to connect to the conductors of the power cable, and lower electrical terminals in the lower barrier are configured to connect to motor leads of the motor. Electrical conductor members in the center chamber extend between the upper and the lower electrical terminals in the upper and lower barriers. Upper chamber dielectric fluid, center chamber dielectric fluid, and lower chamber dielectric fluid fill the upper, center and lower chambers, respectively. The upper chamber dielectric fluid, the center chamber dielectric fluid and the lower chamber dielectric fluid are sealed from each other by the upper and lower barriers. An upper opening in the housing communicates an interior of the coiled tubing with the upper chamber dielectric fluid, enabling thermal expansion of the upper chamber dielectric fluid into the interior of the coiled tubing. The lower chamber is configured to be in fluid communication with motor lubricant in the motor, enabling thermal expansion of the lower chamber dielectric lubricant through the pressure equalizer of the ESP. The center chamber has thermal expansion means for allowing thermal expansion of the center chamber dielectric fluid.

The center chamber thermal expansion means operates independently of the thermal expansions of the lower chamber dielectric fluid and the upper chamber dielectric fluid.

The center chamber thermal expansion means comprises a container located outside of the center chamber. A conduit has an open end in the center chamber for receiving center chamber dielectric fluid. The conduit extends through one of the barriers into the container to allow thermal expansion of the center chamber dielectric fluid.

In the embodiments shown, the conduit extends through the upper barrier. In the first embodiment, the container joins the conduit and comprises a capillary line within the coiled tubing.

In the second embodiment, a flexible container is located in one of the upper and lower chambers. The container has an exterior immersed in the dielectric fluid within said one of the upper and lower chambers. The conduit extends from the center chamber to an interior of the flexible container to admit center chamber dielectric fluid.

In each of the embodiments, the conduit extends through the upper barrier and has an open end in the center chamber for admitting the center chamber dielectric fluid. In the second embodiment, a bellows located in the upper chamber has one side immersed in the upper chamber dielectric fluid and another side in contact with the center chamber dielectric fluid in the conduit.

The center chamber dielectric fluid may comprise a heavier fluid and a lighter fluid.

In the first embodiment, the upper opening in the housing communicates upper chamber dielectric fluid with an annulus between the power cable and the coiled tubing.

In the embodiments shown, the housing has upper and lower housing portions. A parting mechanism selectively allows the upper housing portion to be separated from the lower housing portion to allow retrieval of the coiled tubing in the event the ESP is stuck within a well. The lower barrier is located within the lower housing portion, preventing well fluid from contact with the motor leads after the upper housing portion has separated from the lower housing portion.

DETAILED DESCRIPTION OF THE DISCLOSURE

Figure 1:
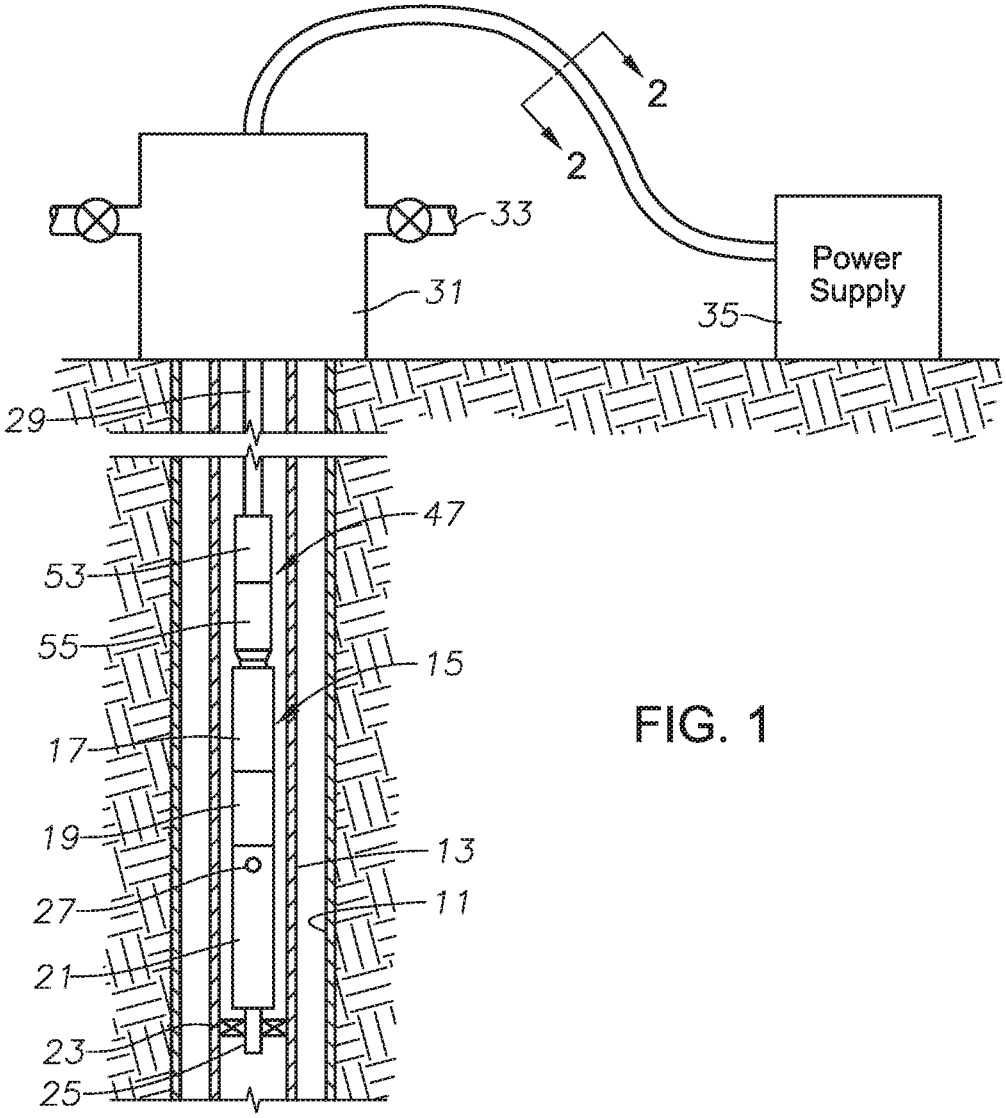
FIG. 1 is a schematic side view of an electrical submersible pump connected to coiled tubing with a connector in accordance with this invention.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" are used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well casing 11 has a string of production tubing 13. Downhole equipment that may be an electrical submersible pump (ESP) 15 is located within production tubing 13. In this example, ESP 15 has an electrical motor 17 on the upper end. A seal section 19 connects to the lower end of motor 17 and has a pressure equalizer, which may be a flexible container such as a bellows or elastomeric bag to reduce a pressure differential between dielectric lubricant in motor 17 and well fluid on the exterior. A pump 21 secures to the lower end of seal section 19. Pump 21 may be a centrifugal pump with a large number of stages, each stage having an impeller and a diffuser. Pump 21 has an intake 25 that extends through a packer 23 for drawing in well fluid. Pump 21 has a discharge 27 on its upper end that discharges well fluid into an annulus surrounding seal section 19 and motor 17 within production tubing 13. Other configurations and types of ESP 15 are feasible.

A string of coiled tubing 29 connects to a connector 47 on the upper end of motor 17 and supports ESP 15 within production tubing 13. The terms "lower", "upper" and the like are used only for convenience because ESP 15 may be operated in other orientations, including horizontal. Coiled tubing 29 is a continuous length of a steel tube that has a capability of being wound around a large reel when out of the well.

A conventional hanger (not shown) supports an upper end portion of coiled tubing 29 within a wellhead assembly or tree 31. Well fluid being pumped by ESP 15 flows from production tubing 13 into tree 31 and out a flow line 33. Coiled tubing 29 extends upward through wellhead assembly 31 and is electrically connected to an adjacent controller or power supply 35.

Figure 2:
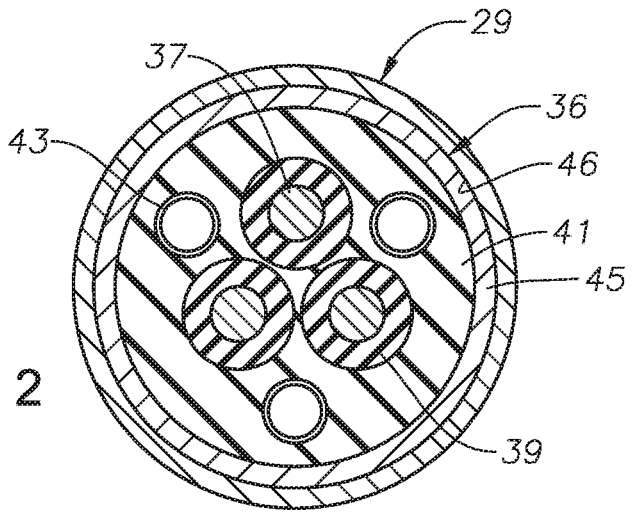
FIG. 2 is a sectional view of the coiled tubing of FIG. 1 taken along the line 2-2 of FIG. 1.

Referring to FIG. 2, coiled tubing 29 contains an electrical power cable 36 for supplying three-phase electrical power to motor 17 (FIG. 1). Power cable 36 has three power conductors 37 that are arranged 120 degrees apart from each other relative to a centerline of power cable 36. Each power conductor 37 is encased in one or more separate electrical insulation layers 39. Also, the three power conductors 37 and their insulation layers 39 may be embedded within an elastomeric jacket 41 extruded over power conductors 37. One or more capillary lines or tubes 43 (three shown) could also be embedded within jacket 41 for fluid flow.

The exterior of jacket 41 is cylindrical and may have a metal strip or armor 45 wrapped helically around it. There is no seal between armor 45 and the inner wall surface of coiled tubing 29, creating a thin inner annulus 46 for fluid to enter. Power cable 36 may be installed in coiled tubing 29 while coiled tubing 29 is being formed into a cylindrical shape and seam welded. Alternately, power cable 36 may be pulled into coiled tubing 29 after coiled tubing 29 has been manufactured. Power cable 36 normally lacks the ability to support its own weight in a well, thus various arrangements may be made to frictionally transfer the weight of power cable 36 to coiled tubing 29 along the length of coiled tubing 29.

Figure 3:
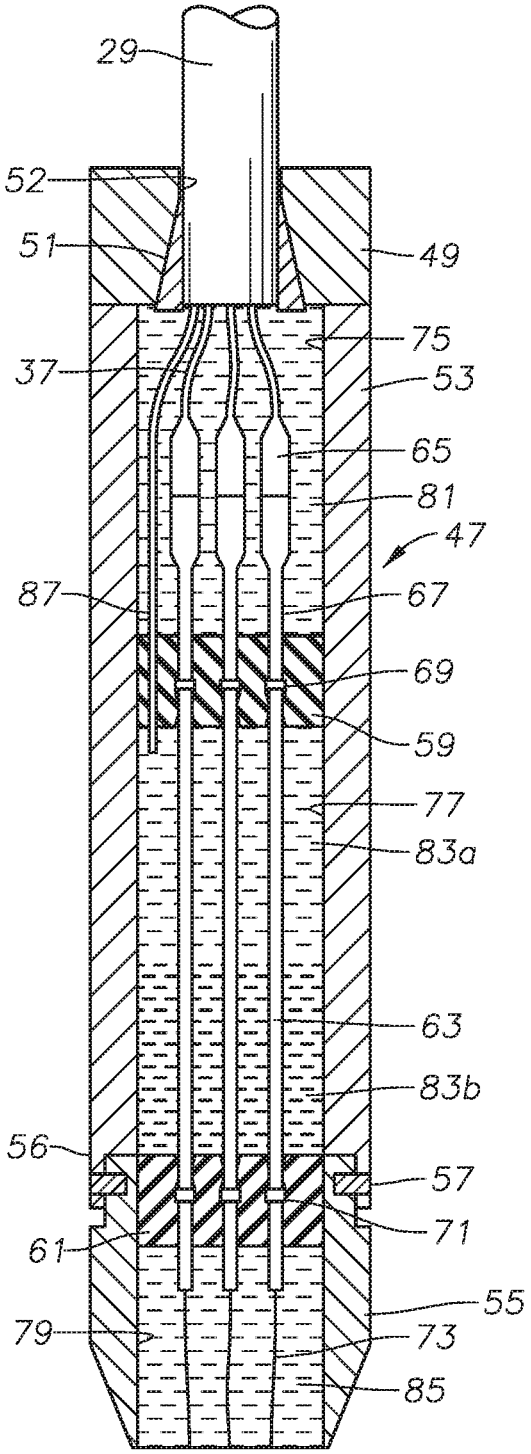
FIG. 3 is a schematic sectional view of one embodiment of the connector of FIG. 1.

Referring to FIG. 3, connector 47 in this embodiment is shown schematically. Connector 47 has a head 49 with a set of slips 51 in an axial upper opening 52. Coiled tubing 29 extends downward through opening 52, and slips 51 grip the lower end portion of coiled tubing 29. Connector 47 has a tubular upper housing 53 and a tubular lower housing 55. In this example, a wall 56 on the lower end of upper housing 53 overlaps an upper wall portion of lower housing 55. Shear screws or pins 57 extend through lateral holes in wall 56 and lower housing 55 to join the lower end of upper housing 53 to the upper end of lower housing 55. Alternately, the overlapping wall 56 could be on the upper end of lower housing 55. Shear pins 57 serve as a parting mechanism to allowing upper housing 53 to separate from lower housing 55 in the event ESP 15 becomes stuck. Lower housing 55 secures to the head of motor 17 (FIG. 1) in a conventional manner.

An upper barrier or seal 59 of electrical insulation material seals across the interior of upper housing 53, and a lower barrier or seal 61 of electrical insulation material seals across the interior of lower housing 55. Upper and lower seals 59, 61 are fixed against axial movement. Upper and lower seals 59, 61 may be formed of a rigid fluoropolymer such as PEEK, and have elastomeric seal rings (not shown) that seal them to the sidewalls of upper and lower housing 53, 55.

Insulated conductor rods 63, one for each power conductor 37 (FIG. 2), have upper ends sealed in passages in upper seal 59 and lower ends sealed in passages in lower seal 61. Electrical splices 65 above upper seal 59 connect power cable conductors 37 to splice conductors 67, which in turn sealingly enter passages in upper seal 59. Upper seal electrical connections or terminals 69 in upper seal 59 electrically join splice conductors 67 with conductor rods 63. Lower seal 61 has lower seal electrical connections terminals 71 that electrically join conductor rods 63 with motor wires 73. Electrical splices 65 and upper and lower electrical connections 69, 71 may be a variety of types.

Upper seal 59 defines an upper chamber 75 that is in fluid communication via opening 52 with inner annulus 46 between power cable armor 45 (FIG. 2) and coiled tubing 29. Upper seal 59 and lower seal 61 define between them a center chamber 77. Lower seal 61 defines below it a lower chamber 79.

An upper chamber dielectric fluid or oil 81 fills upper chamber 75, providing additional electrical insulation around splices 65 and upper seal electrical connections 69. A center chamber dielectric fluid or oil 83*a*, 83*b* optionally may be of two weights or gravities. The lighter weight dielectric fluid 83*a* migrates upward into contact with the lower side of upper seal 59, overlying heavier weight dielectric fluid 83*b*. The heavier weight dielectric fluid 83*b* gravitates downward into contact with the upper side of lower seal 61. The weights of dielectric fluid 83*a*, 83*b* are selected such that the weight of the typical well fluid, mostly water, will be less than heavier weight dielectric fluid 83*b* and more than lighter weight dielectric fluid 83*a*. As a result, if any well fluid manages to leak into the interior of center chamber 77, it will gravitate to a position between lighter weight dielectric fluid 83*a* and heavier weight dielectric fluid 83*b*. This positioning reduces the chances for the well fluid to come into contact with upper and lower seal electrical connections 69, 71.

A lower chamber dielectric fluid or oil 85 fills lower chamber 79. Lower chamber 79 has a lower passage that communicates lower chamber 79 with the flexible container in seal section 19 and the interior of motor 17 (FIG. 1). Lower chamber dielectric fluid 85 is thus in fluid communication with the lubricating oil in seal section 19 and motor 17 (FIG. 1) and may be the same. Lower seal 61 seals lower chamber dielectric fluid 85 from center chamber dielectric fluids 83*a*, 83*b*. Upper seal 59 seals upper chamber dielectric fluid 81 from center chamber dielectric fluids 83*a*, 83*b*.

Center chamber dielectric fluids 83*a*, 83*b* will expand thermally due to operation of motor 17 and the well temperature. Also, when motor 17 is shut down, the cooling of dielectric fluids 83*a*, 83*b* causes them to contract. However, the volume of center chamber 77 is fixed. A thermal expansion device, which includes a conduit or tube 87, will accommodate the expansion and contraction of dielectric fluid 83*a*, 83*b*. The thermal expansion devices for center chamber 77 operates independently of the thermal expansion and contraction occurring in the upper chamber 75 and lower chamber 79.

In this example, thermal expansion tube 87 leads upward through upper chamber 75 and joins one of the capillary tubes 43 (FIG. 2) in power cable 36. Thermal expansion tube 87 may be a rigid tube that extends downward through upper chamber 75 and sealingly through upper seal 69. Thermal expansion tube 87 has an open lower end within center chamber 77. The capillary tube 43 joined by thermal expansion tube 87 serves as a container for receiving thermally expanding center chamber dielectric fluid 83*a*, 83*b*. The upper end of capillary tube 43 will be at the upper end of coiled tubing 29 at or adjacent wellhead assembly 31 (FIG. 1) and may be open. Much of the capillary tube 43 joined by thermal expansion tube 87 will be empty, allowing center chamber dielectric lubricant 83*a*, 83*b* to migrate into these upper portions in response to a thermal increase in volume. Also, upon cooling, center chamber dielectric lubricant 83*a*, 83*b* can migrate back downward into center chamber 77. In this example, the fluid pressure within center chamber 77 will be based on the column, if any, of dielectric lubricant 83*a*, 83*b* in capillary tube 43, not the hydrostatic pressure of well fluid on the exterior of connector 47.

Thermal expansion and contraction of upper chamber dielectric fluid 81 causes some of it to migrate upward and downward in annulus 46 between power cable 36 and coiled tubing 29 (FIG. 2). Annulus 46 extends the length of coiled tubing 29 and may be open at the upper end. The fluid pressure within upper chamber 75 will be based on the column, if any, of upper chamber dielectric fluid 81 in annulus 46, not the hydrostatic pressure of well fluid on the exterior of connector 47.

Lower chamber dielectric lubricant 85 will be at the same pressure as the motor lubricant, which is equalized with well fluid pressure by the pressure equalizer in seal section 19 (FIG. 1). Seal section 19 has a bellows or flexible bag that will handle thermal expansion and contraction of lower chamber dielectric fluid 85. Upper chamber dielectric fluid 81 and center chamber dielectric fluid 83*a*, 83*b* will be at a lesser pressure than the pressure of lower chamber dielectric fluid 85 because their pressures are not pressure compensated by seal section 19 to equalize with well fluid pressure.

Figure 4:
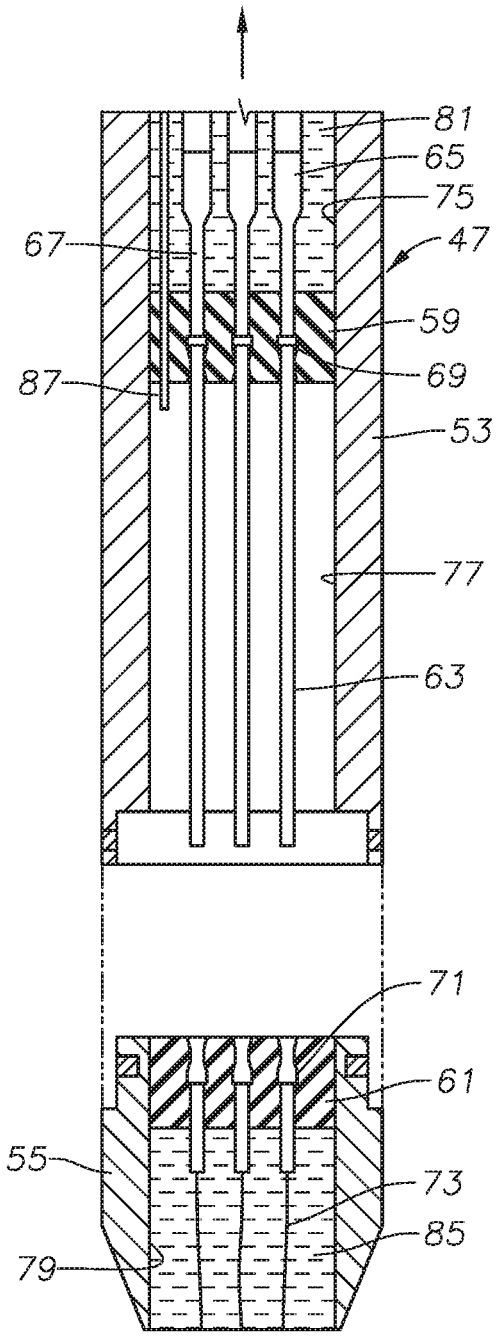
FIG. 4 illustrates an upper portion of the connector of FIG. 3 parted from the lower portion.

Periodically, ESP 15 (FIG. 1) must to be retrieved for maintenance. ESP 15 could be stuck in tubing 13 due to sand accumulation between ESP 15 and tubing 13. Coiled tubing 29 may not have adequate strength to pull ESP 15 loose. As illustrated in FIG. 4, shear pins 57 (FIG. 3) are designed to shear at a lower level than the tensile strength of coiled tubing 29. Upper housing 53 will part from lower housing 55, allowing coiled tubing 29 to be retrieved along with upper housing 53. Lower seal 61 remains sealed in lower housing 55 and will continue to keep lower chamber 79 sealed from well fluid. The upward movement of upper housing 53 opens the lower end of center chamber 77, admitting well fluid. Conductor rods 63 may remain affixed to upper seal 59. Upper seal 59 may continue to seal in upper housing 53. The operator may then run in with a fishing string (not shown) of greater tensile strength than coiled tubing 29 that will engage lower housing 55 and pull it along with motor 17, seal section 19 and pump 21 from the well.

Figure 5A:
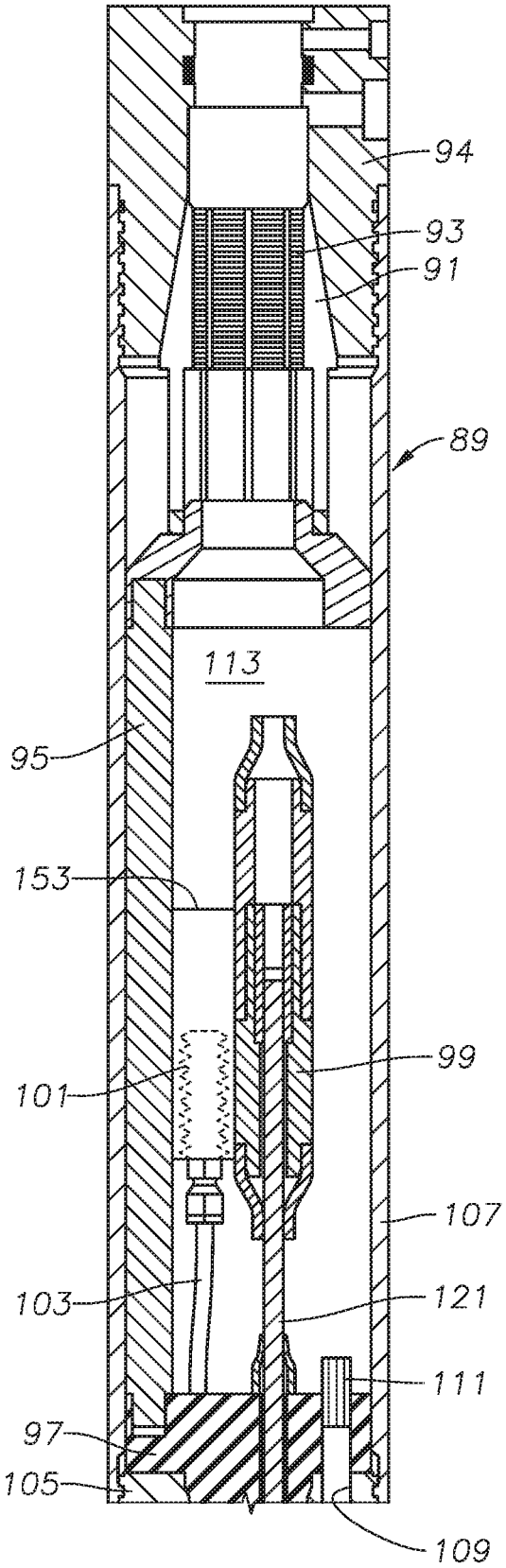
FIGS. 5A, 5B and 5C comprises a sectional view in more detail of an another embodiment of the connector of FIG. 1.
Figure 5B:
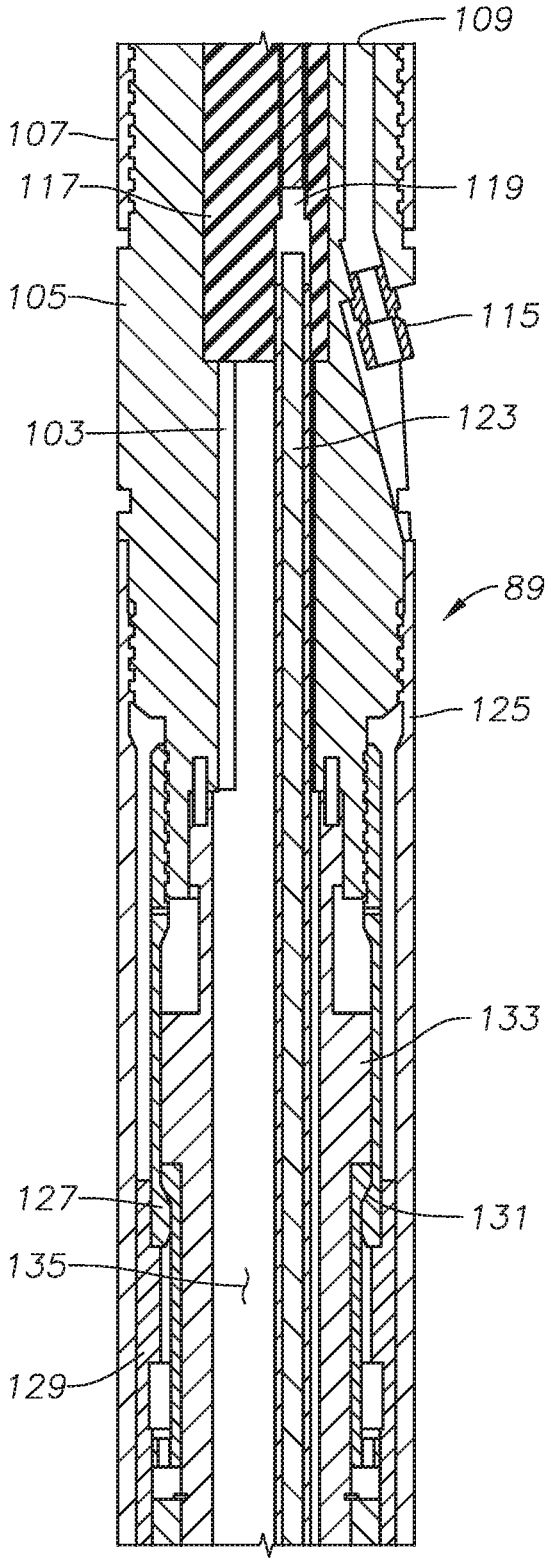
Figure 5C:
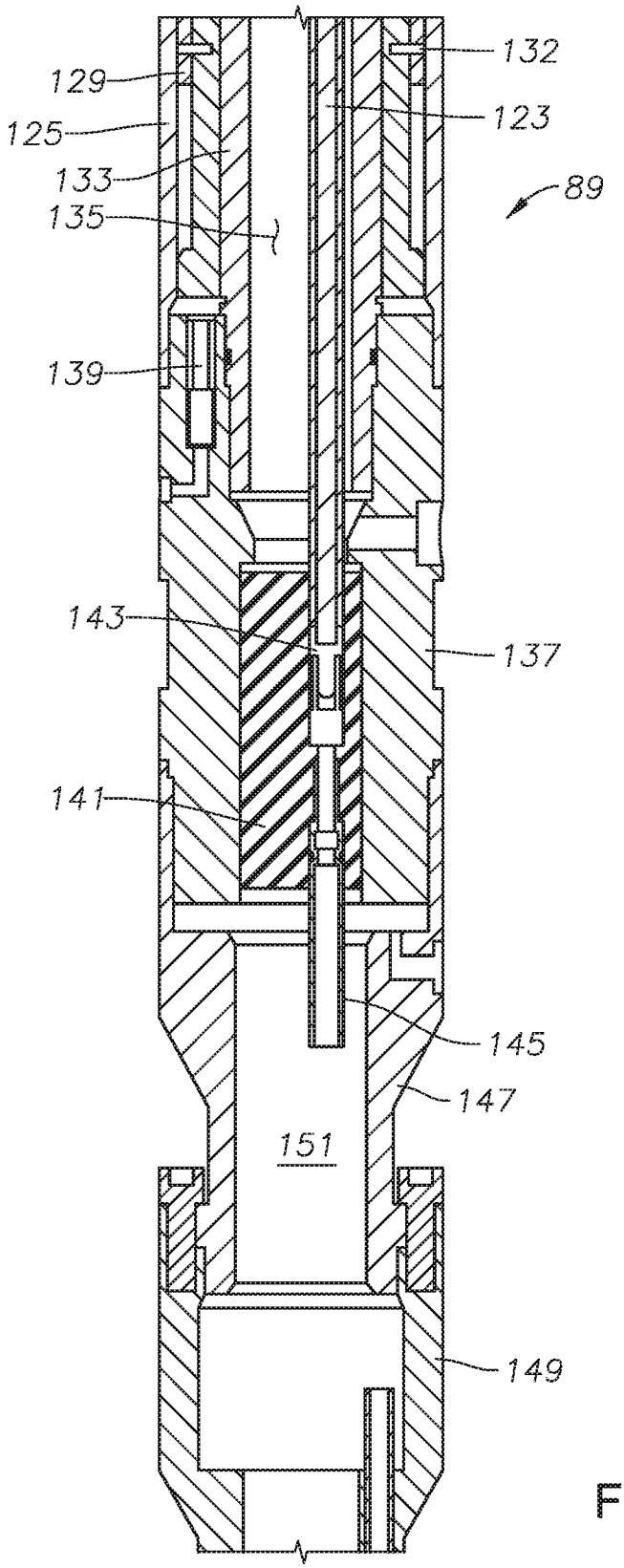

Referring to FIG. 5A-C, connector 89 is shown in more detail than connector 47 of FIGS. 3-4. A collet 91 has internal transverse grooves 93 that grip the exterior of coiled tubing 29 (FIG. 1) when head 94 is tightened. Three collet support columns 95 (only one shown) are secured on their lower ends to a collet base 97; the upper ends of collet support columns 95 support collet 91 against downward movement when head 94 is tightened. Only one of the three electrical splices 99 is shown, and the power conductors 37 (FIG. 2) are not illustrated. A flexible container, which may be a bellows 101 that can expand and contract in volume, is positioned alongside electrical splices 99. An expansion tube 103 leads to the lower end of bellows 101.

Collet base 95 rests on a threaded breakout sub 105, which secures to the lower end of an upper housing section 107 and may be considered to be a part of upper housing section 107. The upper end of upper housing section 107 secures to head 94. Breakout sub 105 optionally has a port 109 extending from its upper end within upper housing section 107 to its exterior, as shown in FIG. 5B. Port 109 has an upper sealed fitting 111 for connecting to one of the capillary tubes 43 (FIG. 3). Head 94, upper housing section 107 and breakout sub 105 define an upper dielectric fluid chamber 113. A lower fitting 115 is located at the lower end of port 109, as shown in FIG. 5B. Lower fitting 115 may connect to a capillary tube (not shown) extending downward to the lower end of ESP 15 (FIG. 1) for delivering chemicals or other fluids pumped down one of the capillary tubes 43 (FIG. 2).

An upper barrier or seal 117 seals a central bore in upper breakout sub 105, defining a lower end of upper dielectric fluid chamber 113. Three upper seal electrical connectors or terminals 119 (only one shown) connect to electrical splice conductors 121 extending down from splices 99. The upper ends of three insulated conductor rods 123 (only one shown) join upper seal electrical connectors 119.

Another upper housing portion 125 secures by threads to the lower end of breakout sub 105. A collet 127 secures to a lower portion of breakout sub 105 and has fingers on its lower end that are biased outward toward a released position. A lock or restraint ring 129 traps the fingers of collet 127 in a radially inward locked position in engagement with a shoulder sleeve 131 while restraint ring 129 is in the upper released position. Hydraulic fluid pressure supplied from one of the capillary tubes 43 (FIG. 2) will communicate through passages (not shown) to an upper side of restraint ring 129. Once the pressure is adequate, it will shear pins 132 (FIG. 5C), causing restraint ring 129 to move downward. The downward movement frees the fingers of collet 127 to spring outward, releasing collet 127 from shoulder sleeve 131.

Shoulder sleeve 131 surrounds a male sub 133 that extends upward into sealing but not securing engagement with breakout sub 105. Male sub 133 is held in sealing engagement with breakout sub 105 by collet 127, shoulder sleeve 131 and restraint ring 129. Male sub 133 extends downward in upper housing portion 125 and has a center bore or chamber 135 through which conductor rods 123 extend. Referring to FIG. 5C, the lower end of male sub 133 secures by threads to a lower housing section 137. A check valve 139 may be employed to vent fluid displaced by the downward movement of restraint ring 129.

A lower barrier or seal 141 seals a bore in lower housing 137, defining a lower end of center chamber 135. Lower seal 141 has three electrical terminals or connectors 143 (only one shown), each sealed within a passage for engagement by the lower end of one of the conductor rods 123. A motor wire sealing arrangement 145 electrically connects one of the motor wires (not shown) to the lower side of one of the lower seal electrical connectors 143. Lower housing 137 secures by threads to an adapter 147. Adapter 147 secures to a base 149 for connection to motor 17 (FIG. 1).

Lower seal 141 defines the upper end of a lower dielectric fluid chamber 151 that will be filled with and in communication with lubricant in motor 17 and seal section 19 (FIG. 1). Center dielectric fluid chamber 135 will be filled with a central chamber dielectric fluid. As in the first embodiment, the dielectric fluid in center chamber 135 may be of two different weights. Upper chamber 113 (FIG. 5A) will be filled with a dielectric fluid that is in communication with the annulus 46 between power cable 36 and coiled tubing 29 (FIG. 2). Upper seal 117 seals the fluid in upper chamber 113 from the fluid in center chamber 135.

Thermal expansion tube 103 has an open lower end in center chamber 135, thus dielectric fluid in center chamber 135 will be in communication with the interior of bellows 101. Bellows 101 may be located in a shell 153 with openings to admit dielectric fluid in upper chamber 113. The exterior of bellows 101 is thus immersed in dielectric fluid in upper chamber 113. Heat may cause the dielectric fluid in center chamber 135 to expand, increasing the volume of bellows 101 to accommodate the increase in volume of dielectric fluid. Cooling of the dielectric fluids when motor 17 is shut down may cause bellows 101 to contract. Expansion of dielectric fluid in upper chamber 113 is accommodated by allowing some of the fluid to migrate up annulus 46 between power cable 36 and coiled tubing 29 (FIG. 2). Thermal expansion of dielectric fluid in lower chamber 151 is handled by the flexible container or pressure equalizer in seal section 19 (FIG. 1).

Upon retrieval, if ESP 15 is stuck, the operator may apply hydraulic fluid pressure to one of the capillary tubes 43 (FIG. 3), causing restraint ring 129 to move downward. The downward movement frees the fingers of collet 127 to spring out, releasing male sub 133 from breakout sub 105. An upward pull will separate upper housing section 125 from lower housing section 137, allowing upper housing sections 107 and 125 to be retrieved along with conductor rods 123 and breakout sub 105. Male sub 133 remains attached to lower housing section 137. Lower seal 141 seals the upper end of lower dielectric fluid chamber 151 from well fluid that enters central dielectric fluid chamber 135 after upper housing section 125 releases from lower housing section 137. Subsequently, an operator may lower a fishing string with a fishing tool to engage male sub 133.

The present invention described herein, therefore, is well adapted to carry out the objects and attain the ends and advantages mentioned, as well as others inherent therein. While only a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. An apparatus for connecting an electrical submersible pump assembly (ESP) to a string of coiled tubing containing a power cable having power conductors, the ESP and coiled tubing adapted to be installed within a well, the ESP having a pump, a motor, and a pressure equalizer for reducing a pressure difference between motor lubricant in the motor and well fluid surrounding the motor, the apparatus comprising:

a tubular housing configured to connect between a lower end of the coiled tubing and an upper end of the motor;

upper and lower barriers in the housing, defining an upper chamber above the upper barrier, a center chamber between the upper and lower barriers, and a lower chamber below the lower barrier;

upper electrical terminals in the upper barrier configured to connect to the conductors of the power cable, and lower electrical terminals in the lower barrier configured to connect to motor leads of the motor;

electrical conductor members in the center chamber extending between the upper and the lower electrical terminals in the upper and lower barriers;

upper chamber dielectric fluid, center chamber dielectric fluid, and lower chamber dielectric fluid filling the upper, center and lower chambers, respectively, the upper chamber dielectric fluid, the center chamber dielectric fluid and the lower chamber dielectric fluid being sealed from each other by the upper and lower barriers;

an upper opening in the housing for communicating an interior of the coiled tubing with the upper chamber dielectric fluid, enabling thermal expansion of the upper chamber dielectric fluid into the interior of the coiled tubing;

the lower chamber being configured to be in fluid communication with motor lubricant in the motor, enabling thermal expansion of the lower chamber dielectric lubricant through the pressure equalizer of the ESP; and center chamber thermal expansion means for allowing thermal expansion of the center chamber dielectric fluid.

2. The apparatus according to claim 1, wherein the center chamber thermal expansion means operates independently of the thermal expansions of the lower chamber dielectric fluid and the upper chamber dielectric fluid.

3. The apparatus according to claim 1, wherein the center chamber thermal expansion means comprises:

a container located outside of the center chamber; and a conduit having an open end in the center chamber for receiving center chamber dielectric fluid, the conduit extending through one of the barriers into the container to allow thermal expansion of the center chamber dielectric fluid.

4. The apparatus according to claim 3 wherein:

the conduit extends through the upper barrier; and the container joins the conduit and comprises a capillary line within the coiled tubing.

5. The apparatus according to claim 1, wherein the center chamber thermal expansion device comprises:

a flexible container located in one of the upper and lower chambers, the container having an exterior immersed in the dielectric fluid within said one of the upper and lower chambers; and a conduit extending from the center chamber to an interior of the flexible container to admit center chamber dielectric fluid.

6. The apparatus according to claim 1, wherein the center chamber thermal expansion device comprises:

a conduit having an open end in the center chamber for admitting the center chamber dielectric fluid, the conduit extending through the upper barrier;

a bellows located in the upper chamber, the bellows having one side immersed in the upper chamber dielectric fluid and another side in contact with the center chamber dielectric fluid in the conduit.

7. The apparatus according to claim 1, wherein the center chamber dielectric fluid comprises a heavier fluid and a lighter fluid.

8. The apparatus according to claim 1, wherein:

the upper opening in the housing communicates upper chamber dielectric fluid with an annulus between the power cable and the coiled tubing.

9. The apparatus according to claim 1, wherein:

the housing has upper and lower housing portions; and the apparatus further comprises:

a parting mechanism that selectively allows the upper housing portion to be separated from the lower housing portion to allow retrieval of the coiled tubing in the event the ESP is stuck within a well; and wherein the lower barrier is located within the lower housing portion, preventing well fluid from contact with the motor leads after the upper housing portion has separated from the lower housing portion.

10. A well fluid pumping apparatus for pumping well fluid from a well, comprising:

a string of coiled tubing having a power cable therein, defining an annulus between the power cable and the coiled tubing, the power cable having a plurality of power conductors;

a connector housing having an upper end secured to the coiled tubing;

an electrical submersible pump assembly (ESP) secured to a lower end of the housing, the ESP having a motor filled with a motor lubricant and a pressure equalizer to reduce a pressure differential between the motor lubricant and well fluid in the well;

upper and lower barriers in the housing, defining an upper chamber, a lower chamber, and a center chamber between the upper and lower chambers, the upper and lower barriers sealing the center chamber from the upper and lower chambers;

upper chamber dielectric fluid in the upper chamber in fluid communication with the annulus in the coiled tubing;

lower chamber dielectric fluid in the lower chamber in fluid communication with motor lubricant in the pressure equalizer;

center chamber dielectric fluid in the center chamber that is sealed from contact with the upper and lower chamber dielectric fluids by the upper and lower barriers;

upper electrical terminals in the upper barrier joined to the power conductors, and lower electrical connections in the lower barrier joined to motor leads of the motor;

electrical conductor rods in the center chamber extending between the upper and the lower electrical terminals in the upper and lower barriers; and a thermal expansion device having an inlet within the center chamber and a container portion for allowing center chamber dielectric fluid to expand into the container in response to thermal expansion.

11. The apparatus according to claim 10, wherein:

the housing has upper and lower housing portions; and the apparatus further comprises:

a parting mechanism that selectively allows the upper housing portion and the conductor rods to be separated from the lower housing portion to allow retrieval of the coiled tubing in the event the ESP is stuck within a well; and wherein the lower barrier is located within the lower housing portion, preventing well fluid from contact with the motor leads after the upper housing portion has separated from the lower housing portion.

12. The apparatus according to claim 10, wherein the center chamber dielectric fluid comprises a layer of lighter dielectric fluid overlying and in contact with a layer of heavier dielectric fluid.

13. The apparatus according to claim 10, wherein during operation of the motor and while installed in a well, a pressure of the upper dielectric fluid within the upper chamber will be less than a pressure of the lower dielectric fluid within the lower chamber.

14. The apparatus according to claim 10, wherein:

the container portion of thermal expansion device comprises a capillary tube within the coiled tubing; and the thermal expansion device further comprises a conduit extending through the upper barrier and the upper chamber to the capillary tube.

15. The apparatus according to claim 10, wherein:

the container portion of the thermal expansion device comprises a flexible container.

16. The apparatus according to claim 10, wherein:

the container portion of the thermal expansion device comprises a bellows located within the upper chamber, the bellows having an interior filled with center chamber dielectric fluid and an exterior immersed in upper chamber dielectric fluid.

17. An apparatus for connecting an electrical submersible pump assembly (ESP) to a string of coiled tubing containing a power cable having power conductors, the ESP and coiled tubing adapted to be installed within a well, the ESP having a pump, a motor, and a pressure equalizer for reducing a pressure difference between motor lubricant in the motor and well fluid surrounding the motor, the apparatus comprising:

a tubular housing configured to connect between a lower end of the coiled tubing and an upper end of the motor, the housing having an upper housing portion and a lower housing portion;

an upper barrier sealed in the upper housing portion, defining an upper chamber above the upper barrier;

a lower barrier sealed in the lower housing portion, defining a lower chamber below the lower barrier;

a center chamber between the upper and lower barriers;

upper electrical terminals in the upper barrier configured to connect to the power conductors of the power cable, and lower electrical terminals in the lower barrier configured to connect to motor leads of the motor;

electrical conductor members in the center chamber extending between the upper and the lower electrical terminals in the upper and lower barriers;

upper chamber dielectric fluid, center chamber dielectric fluid, and lower chamber dielectric fluid filling the upper, center and lower chambers, respectively, the upper chamber dielectric fluid, the center chamber dielectric fluid and the lower chamber dielectric fluid being sealed from each other by the upper and lower barriers;

a parting mechanism that selectively allows the upper housing portion and the conductor members to be separated from the lower housing portion to allow retrieval of the coiled tubing in the event the ESP is stuck within a well; and wherein the parting mechanism causes the lower barrier to remain sealed in the lower housing portion, preventing well fluid from contact with the motor leads in the lower chamber after the upper housing portion has separated from the lower housing portion.

18. The apparatus according to claim 17, wherein:

the upper housing portion and the lower housing portion have overlapping walls; and the the parting mechanism comprises shear members extending through the overlapping walls.

19. The apparatus according to claim 17, wherein the parting mechanism comprises:

outward biased collet fingers having a locked position that retains the lower housing portion with the upper housing portion and a released position that allows the collet fingers to spring outward, releasing the upper housing portion from the lower housing portion;

a lock sleeve that selectively restrains the collet fingers in the locked position, the lock sleeve being slidable in response to hydraulic fluid pressure applied to the lock sleeve to free the collet fingers to move to the released position.

20. The apparatus according to claim 17, further comprising:

thermal expansion means enabling the center chamber dielectric fluid to expand beyond the center chamber in response to a thermal increase, and to contract back into the center chamber in response to a thermal decrease without contacting the upper chamber dielectric fluid and the lower chamber dielectric fluid.

* * * * *